US011642882B2

(12) United States Patent
Maeda

(10) Patent No.: US 11,642,882 B2
(45) Date of Patent: May 9, 2023

(54) LIQUID EJECTION APPARATUS AND DATA TRANSMISSION METHOD

(71) Applicant: Takatsugu Maeda, Kanagawa (JP)

(72) Inventor: Takatsugu Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 17/411,280

(22) Filed: Aug. 25, 2021

(65) Prior Publication Data

US 2022/0063265 A1 Mar. 3, 2022

(30) Foreign Application Priority Data

Sep. 3, 2020 (JP) ..... JP2020-148289

(51) Int. Cl.
*B41J 2/045* (2006.01)

(52) U.S. Cl.
CPC ..... *B41J 2/04536* (2013.01); *B41J 2/04586* (2013.01)

(58) Field of Classification Search
CPC ..... B41J 2/04536
See application file for complete search history.

(56) References Cited

U.S. PATENT DOCUMENTS

2012/0162694 A1* 6/2012 Sakai ..... G06K 15/408 358/1.14
2016/0342869 A1 11/2016 Miyata et al.
2017/0208186 A1* 7/2017 Kimura ..... G06F 3/1285
2017/0359483 A1* 12/2017 Uematsu ..... H04N 1/648

FOREIGN PATENT DOCUMENTS

JP 2012-125981 7/2012
JP 6487770 3/2019

* cited by examiner

*Primary Examiner* — Scott A Richmond
(74) *Attorney, Agent, or Firm* — Duft & Bornsen, PC

(57) ABSTRACT

A liquid ejection apparatus includes a transmission-side control device and a reception-side control device. The transmission-side control device is configure to: divide image data into a plurality of division data; add check data for error detection to each of the plurality of division data; and transmit, to a reception-side control device, each of the plurality of division data to which respective check data are added. The reception-side control device is configured to: receive each of the plurality of division data to which the respective check data are added; perform error detection on each of the plurality of division data, using check data added to the division data; and transmit, to a drive device configured to control a drive element, division data on which a process of error detection is performed, in parallel with a process of transmitting division data by the transmission-side control device.

8 Claims, 8 Drawing Sheets

LIQUID EJECTION APPARATUS AND DATA TRANSMISSION METHOD

CROSS-REFERENCE TO RELATED APPLICATIONS

The present application claims priority under 35 U.S.C. § 119 to Japanese Patent Application No. 2020-148289, filed on Sep. 3, 2020. The contents of which are incorporated herein by reference in their entirety.

BACKGROUND OF THE INVENTION

1. Field of the Invention

The present invention relates to a liquid ejection apparatus and a data transmission method.

2. Description of the Related Art

There is a technique of performing error detection on data to be transferred to an inkjet head in an inkjet printer (liquid ejection apparatus).

A technique of adding check data for error detection (error detection code) to data to be transferred and performing error detection has been disclosed as such inkjet printers for performing error detection (for example, Japanese Patent No. 6487770).

According to a conventional technique, however, error detection on image data is performed on a nozzle array basis and, in general, error detection is performed using check data for error detection that is added to the end of image data and there is a problem in that, even when data is transmitted to a head drive device after all data is received and error detection is performed, it is not possible to send all the data completely until a latch signal for the next image data and thus it is not possible to increase the printing speed.

SUMMARY OF THE INVENTION

According to ab aspect of the present invention, a liquid ejection apparatus includes a transmission-side control device and a reception-side control device. The transmission-side control device is configured to transmit image data to an ejection head. The reception-side control device is configured to transmit data obtained by processing the image data received from the transmission-side control device, to a drive device configured to control a drive element. The transmission-side control device includes a divider, an adder, and a first transmitter. The divider is configured to divide the image data into a plurality of division data. The adder is configured to add check data for error detection to each of the plurality of division data divided by the divider. The first transmitter is configured to transmit, to the reception-side control device, each of the plurality of division data to which the adder adds respective check data. The reception-side control device includes a receiver, an error detector, and a second transmitter. The receiver is configured to receive each of the plurality of division data that are transmitted from the first transmitter, and to which the respective check data are added. The error detector is configured to perform error detection on each of the plurality of division data received by the receiver, using check data added to the division data. The second transmitter is configured to transmit, to the drive device, division data on which a process of error detection is performed by the error detector, in parallel with a process of transmitting division data by the first transmitter.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
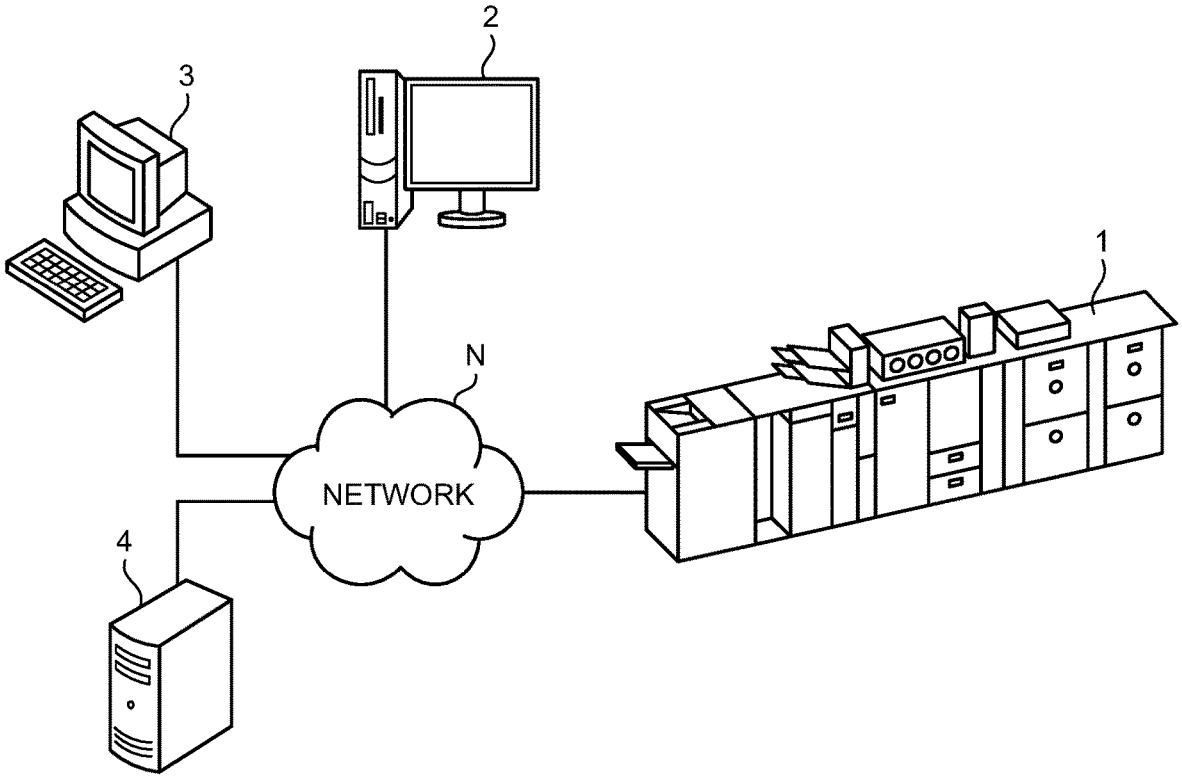
FIG. 1 is a diagram illustrating a general configuration of a printing system according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a liquid ejection apparatus and a data transmission method that make it possible to increase a printing speed while performing error detection on image data to the inkjet head An embodiment of a liquid ejection apparatus and a data transmission method according to the disclosure will be describe in detail below with reference to the accompanying drawings. The following embodiment does not limit the disclosure and the components of the following embodiment include ones that can be easily reached by those skilled in the art and ones substantially the same, that is, ones in the scope of equivalence. Furthermore, various omissions, replacements, changes and combinations of components can be made without departing from the scope of the embodiment below.

General Configuration of Printing System

FIG. 1 is a diagram illustrating a general configuration of a printing system according to the embodiment. With reference to FIG. 1, the general configuration of the printing system according to the embodiment will be described.

As illustrated in FIG. 1, the printing system according to the embodiment includes an image forming apparatus 1, a digital front end (DFE) 2, a client personal computer (PC) 3, and a management server 4 as an example. As illustrated in FIG. 1, each device is able to perform mutual data communication via a network N. The network N is, for example, a network that includes a local area network (LAN) or the Internet and that is a wired network, wireless network, or a network of a combination of a wired network and a wireless network.

The image forming apparatus 1 is an inkjet printer (liquid ejection apparatus) that performs image formation (printing) on a recording medium by an inkjet system based on drawing data (image data) that is received from the DFE 2. A specific hardware configuration and a specific mechanical schematic configuration of the image forming apparatus 1 will be descried below using FIG. 2 and FIG. 5.

The DFE 2 is an information processing device that receives a printing job from the client PC 3 or the management server 4, prepares drawing data based on the printing job by a raster image processor (RIP) engine, and transmits the drawing data to the image forming apparatus 1. A specific hardware configuration of the DFE 2 will be described below using FIG. 3.

The client PC 3 is an information processing device that prepares a printing job that a user wants to print and transmits the printing job to the DFE 2 or the management server 4. A specific hardware configuration of the client PC 3 will be described below using FIG. 4.

The management server 4 is a server device that manages the printing job that is received from the client PC 3 and transmits the printing job to the DFE 2 according to a request from the DFE 2. A specific configuration of the management server 4 will be described below using FIG. 4.

Hardware Configuration of Image Forming Apparatus

Figure 2:
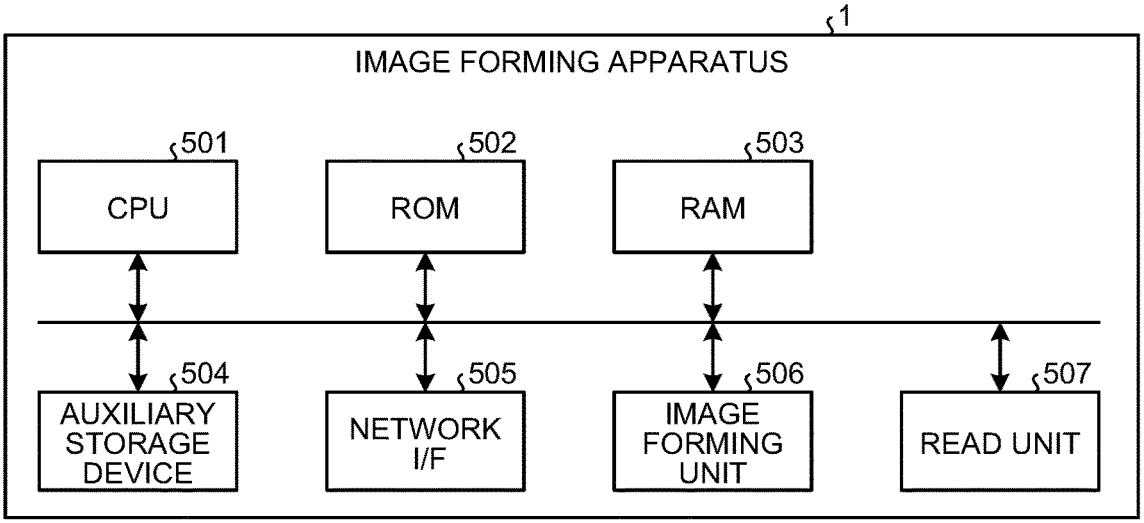
FIG. 2 is a diagram illustrating an example of a hardware configuration of an image forming apparatus according to the embodiment.

FIG. 2 is a diagram illustrating an example of the hardware configuration of the image forming apparatus according to the embodiment. With reference to FIG. 2, the hardware configuration of the image forming apparatus 1 according to the embodiment will be described.

As illustrated in FIG. 2, the image forming apparatus 1 includes a central processing unit (CPU) 501, a read only memory (ROM) 502, a random access memory (RAM) 503, an auxiliary storage device 504, a network I/F 505, an image forming unit 506, and a read unit 507.

The CPU 501 is an arithmetic logic unit that controls the image forming apparatus 1 generally. The ROM 502 is a non-volatile storage device that stores programs, data, etc. The RAM 503 is a volatile storage device that is used as a work area of the CPU 501 and into which programs, data, etc., are loaded.

The auxiliary storage device 504 is a storage device, such as a hard disk drive (HDD), a solid state drive (SSD), or a flash memory, and is a storage for storing image data, programs, font data, forms, etc.

The network I/F 505 is an interface for communicating with an external device that is connected via the network N that is configured by a wired or wireless data transmission line. The network I/F 505 is, for example, an interface according to the TCP (Transmission Control Protocol)/IP (Internet Protocol).

The image forming unit 506 is a printing device that performs image formation (printing) by ejecting ink onto a recording medium by the inkjet system.

The read unit 507 is a scanner that performs a read operation on a recording medium on which the image forming unit 506 has performed image formation is performed by.

The CPU 501, the ROM 502, the RAM 503, the auxiliary storage device 504, the network I/F 505, the image forming unit 506, and the read unit 507 are connected via buses, such as an address bus and a data bus, such that they are able to communicate with one another.

The hardware configuration of the image forming apparatus 1 illustrated in FIG. 2 illustrates an example, and the image forming apparatus 1 need not include all the components illustrated in FIG. 2 and the image forming apparatus 1 may include other components.

Hardware Configuration of DFE

Figure 3:
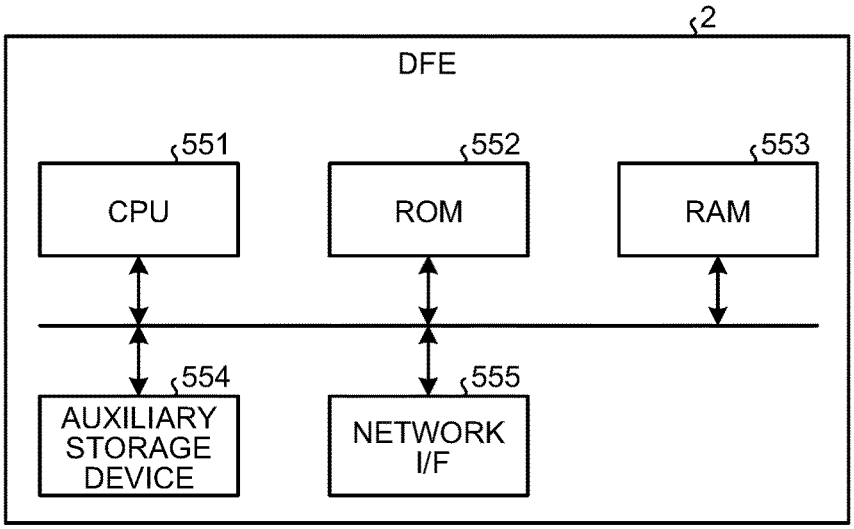
FIG. 3 is a diagram illustrating an example of a hardware configuration of a DFE according to the embodiment.

FIG. 3 is a diagram illustrating an example of a hardware configuration of the DFE according to the embodiment. With reference to FIG. 3, the hardware configuration of the DFE 2 according to the embodiment will be described.

As illustrated in FIG. 3, the DFE 2 includes a CPU 551, a ROM 552, a RAM 553, an auxiliary storage device 554, and a network I/F 555.

The CPU 551 is an arithmetic logic unit that controls general operations of the DFE 2. The ROM 552 is a non-volatile storage device that stores a program for the DFE 2. The RAM 553 is a volatile storage device that is used as a work area of the CPU 551.

The auxiliary storage device 554 is a storage device that stores various types of data and programs, such as a HDD or a SSD.

The network I/F 555 is an interface for performing data communication with the image forming apparatus 1, the client PC 3, and the management server 4 using the network N. The network I/F 555 is, for example, a network interface card (NIC) that corresponds to Ethernet (trademark) and that is capable of communication according to TCP/IP, or the like.

The CPU 551, the ROM 552, the RAM 553, the auxiliary storage device 554, and the network I/F 555 are connected such that they are able to communicate with one another via buses, such as an address bus and a data bus.

The hardware configuration of the DFE 2 illustrated in FIG. 3 represents an example, and the DFE 2 need not include all the components illustrated in FIG. 3 and the DFE 2 may include other components.

Hardware Configuration of Client PC and Management Server

Figure 4:
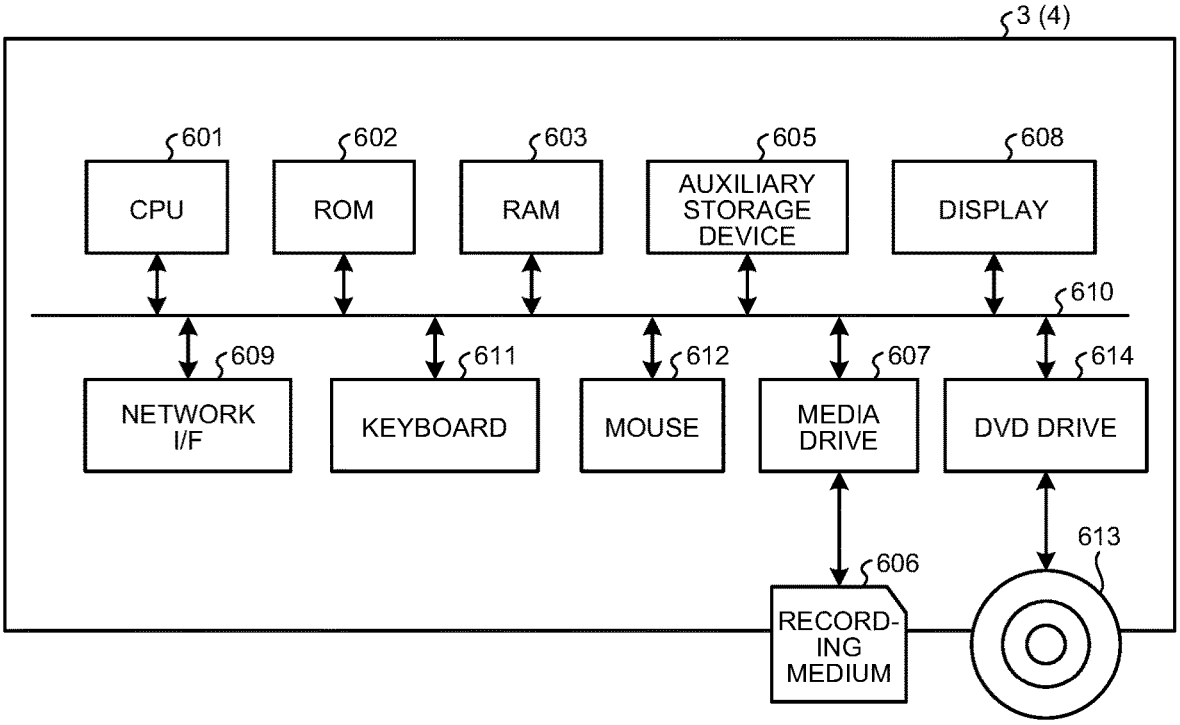
FIG. 4 is a diagram illustrating a hardware configuration of a client PC according to the embodiment.

FIG. 4 is a diagram illustrating an example of a hardware configuration of the client PC according to the embodiment. With reference to FIG. 4, the hardware configurations of the client PC 3 and the management server 4 according to the embodiment will be described. Note that the configurations will be described below as the configuration of the client PC 3.

As illustrated in FIG. 4, the client PC 3 includes a CPU 601, a ROM 602, a RAM 603, an auxiliary storage device 605, a media drive 607, a display 608, a network I/F 609, a keyboard 611, a mouse 612, and a digital versatile disc (DVD) drive 614.

The CPU 601 is an arithmetic logic unit that controls general operations of the client PC 3. The ROM 602 is a non-volatile storage device that stores a program for the client PC 3. The RAM 603 is a volatile storage device that is used as a work area of the CPU 601.

The auxiliary storage device 605 is a storage device that stores various types of data and programs, such as a HDD or a SSD. The media drive 607 is a device that controls reading data from and writing data in a recording medium 606, such as a flash memory, according to the control of the CPU 601.

The display 608 is a display device that displays various types of information, such as a cursor, a menu, a window, letters and images, and that consists of liquid crystals or electroluminescence (EL), etc.

The network I/F 609 is an interface for performing data communication with external devices, such as the DFE 2 and the management server 4, via the network N. The network I/F 609 is, for example, a NIC that corresponds to Ethernet and that is capable of communication according to TCP/IP.

The keyboard 611 is an input device for selecting a character, a number and various instructions, moving a cursor, etc. The mouse 612 is an input device for selecting and executing various instructions, selecting a subject to be processed, moving a cursor, etc.

The DVD drive 614 is a device, such as a DVD ROM or a DVD-R (Digital Versatile Disk Recordable) serving as an example of a detachable recording medium, that controls reading of data from and writing of data in a DVD 613.

The CPU 601, the ROM 602, the RAM 603, the auxiliary storage device 605, the media drive 607, the display 608, the network I/F 609, the keyboard 611, the mouse 612, and the DVD drive 614 that are described above are connected such that they communicate with one another via a bus line 610, such as an address bus and a data bus.

The hardware configuration of the client PC 3 illustrated in FIG. 4 represents an example and the client PC 3, and the client PC 3 need not include all the components illustrated in FIG. 4 and the client PC 3 may include other components.

The hardware configuration of the management server 4 also accords with the hardware configuration illustrated in FIG. 4.

Schematic Configuration of Image Forming Apparatus

Figure 5:
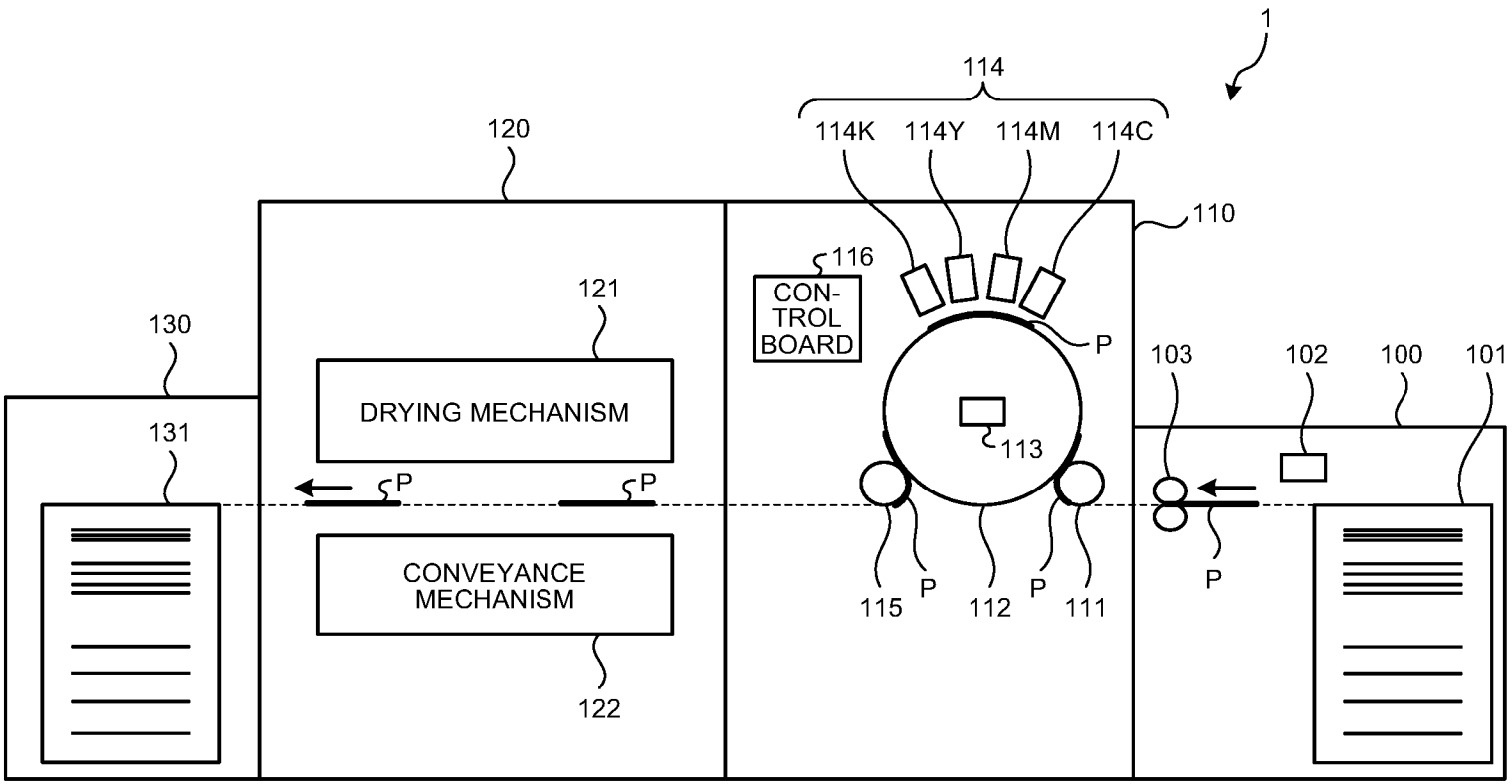
FIG. 5 is a diagram illustrating an example of a schematic configuration of an image forming apparatus according to the embodiment.

FIG. 5 is a diagram illustrating an example of the schematic configuration the image forming apparatus according to the embodiment. With reference to FIG. 5, the mechanical schematic configuration of the image forming apparatus 1 according to the embodiment will be described.

As described above, the image forming apparatus 1 is an inkjet printer that performs image forming (printing) on a recording medium by the inkjet system. As illustrated in FIG. 5, the image forming apparatus 1 includes a sheet feeder 100, an image forming unit 110, a drier 120, and a sheet ejector 130. In the image forming apparatus 1, the image forming unit 110 forms an image using ink that is liquid for image formation on a recording medium P that serves as a sheet member and that is fed from the sheet feeder 100, the drier 120 dries the ink that is attached onto the recording medium P, and the sheet ejector 130 ejects the recording medium P.

The sheet feeder 100 is a unit that feeds the recording medium P serving as a sheet member to the image forming unit 110. The sheet feeder 100 includes a sheet feeding tray 101, a feeding device 102, and a registration roller pair 103.

The sheet feeding tray 101 is a tray on which a plurality of recording media P can be placed.

The feeding device 102 is a device that separates the recording media P one by one from the sheet feeding tray 101 and sends out the recording medium P to a conveying path. Various devices, such as a device using a roller or a device utilizing air suction, are usable as the feeding device 102.

The registration roller pair 103 includes a pair or rollers that send out the recording medium P that is sent out by the feeding device 102 at given timing to the image forming unit 110.

The sheet feeder 100 is not limited to the configuration illustrated in FIG. 5 as long as the sheet feeder 100 has a mechanism capable of sending out the recording medium P to the image forming unit 110.

The image forming unit 110 is a unit that forms an image using ink that is liquid for image formation on the recording medium P that is fed from the sheet feeder 100. The image forming unit 110 can be regarded as the liquid ejection apparatus. The image forming unit 110 includes a receiving body 111, a sheet carrier drum 112, a suction device 113, an inkjet head 114, a passing body 115, and a control board 116.

The receiving body 111 is a roller member that receives the recording medium P that is fed from the sheet feeder 100. The receiving body 111 grips the received recording medium P with a sheet gripper that is provided on the surface of the receiving body 11 and conveys the recording medium P to the sheet carrier drum 112 along the surface.

The sheet carrier drum 112 is a drum member that carries the recording medium P, which is conveyed by the receiving drum 111, on the outer circumferential surface of the sheet carrier drum 112 and conveys the recording medium P along the circumferential surface. A sheet gripper is arranged also on the surface of the sheet carrier drum 112 and an end of the recording medium P is gripped by the sheet gripper. A plurality of suction holes are formed dispersedly on the outer circumferential surface of the sheet carrier drum 112.

The suction device 113 is a device that generates a suction airflow toward the inside of the sheet carrier drum 112 from each of the suction holes that are formed on the outer circumferential surface of the sheet carrier drum 112, thereby causing the recording medium P to be attracted onto the outer circumferential surface of the sheet carrier drum 112.

The inkjet head 114 is a liquid ejection head that ejects ink to the recording medium P that is carried by the sheet carrier drum 112, thereby forming an image. The inkjet head 114 includes an inkjet head 114C that ejects a cyan (C) ink, an inkjet head 114M that ejects a magenta (M) ink, an inkjet head 114Y that ejects a yellow (Y) ink, and an inkjet head 114K that ejects a black (K) ink and forms an image by ejecting the inks of four colors. In other words, the inkjet heads 114C, 114M, 114C and 114K eject the respective colors when the recording medium P that is carried on the sheet carrier drum 112 passes the opposed are, thereby forming an image corresponding to the image data. The word "inkjet head 114" is used to refer to any one of the inkjet heads 114C, 114M, 114C and 114K or collectively refer to the inkjet heads 114C, 114M, 114C and 114K. The configurations of the inkjet heads 114C, 114M, 114C and 114K are not limited as long as the inkjet heads 114C, 114M, 114C and 114K are able to eject ink and various configurations can be employed. An inkjet head that ejects special ink of, white, gold, silver or the like, may be arranged as required or a liquid ejection head that ejects liquid not forming an image, such as a coating solution, may be arranged. An electric configuration of the inkjet head 114 will be described below using FIG. 6.

The passing body 115 is a roller member that passes the recording medium P that is conveyed by the sheet carrier drum 112 to the drier 120.

The control board 116 is a control board that controls an ink ejection operation of the inkjet head 114. The control board 116 controls the ejection operation of the inkjet head 114 according to a drive signal (drive waveform) corresponding to the image data.

The drier 120 is a unit that dries the ink that is adhered onto the recording medium P with the image formed thereon by the image forming unit 110. The drier 120 includes a drying mechanism 121 and a conveyance mechanism 122.

The drying mechanism 121 is a mechanism that performs drying processing on the ink on the recording medium P that is conveyed by the conveyance mechanism 122 to cause the moisture in the ink to evaporate, thereby causing the ink to adhere onto the recording medium P and inhibiting the recording medium P from curling.

The conveyance mechanism 122 is a mechanism that receives the recording medium P, which is conveyed from the image forming unit 110, and conveys the recording medium P through the drier 120.

The sheet ejector 130 is a unit for stacking the recording media P that are conveyed from the drier 120. The sheet ejector 130 includes a sheet ejection tray 131.

The sheet ejection tray 131 is a tray on which the recording media P that are conveyed from the drier 120 are stacked sequentially and stored.

The sheet ejector 130 is not limited to the configuration illustrated in FIG. 5 as long as the sheet ejector is able to eject the recording medium P.

The image forming apparatus 1 illustrated in FIG. 5 is configured such that the image forming apparatus 1 includes the sheet feeder 100, the image forming unit 110, the drier 120, and the sheet ejector 130, and another unit may be added as appropriate. For example, a pre-processor that performs pre-processing of image formation may be added between the sheet feeder 100 and the image forming unit 110 or a post-processor that performs post-processing of image formation may be added between the drier 120 and the sheet ejector 130. A processor that performs a processing solution application process of applying a processing solution that reacts with ink and inhibits bleeding to the recording medium P may be taken as the pre-processor and the content of the pre-processor is not particularly limited. For example, a sheet inversion conveyance processor for inverting the recording medium P with the image formed thereon by the image forming unit 110, sending the recording medium P to the image forming unit 110 again to form images on both the surfaces of the recording medium P, a processor that binds a plurality of recording media P with images formed thereon, a correction mechanism processor that corrects sheet deformation, or a cooling processor that cools the recording medium P is taken as the post processor, and the content of the post processor is not particularly limited.

Configurations of Control Board and Inkjet Head of Image Forming Apparatus

Figure 6:
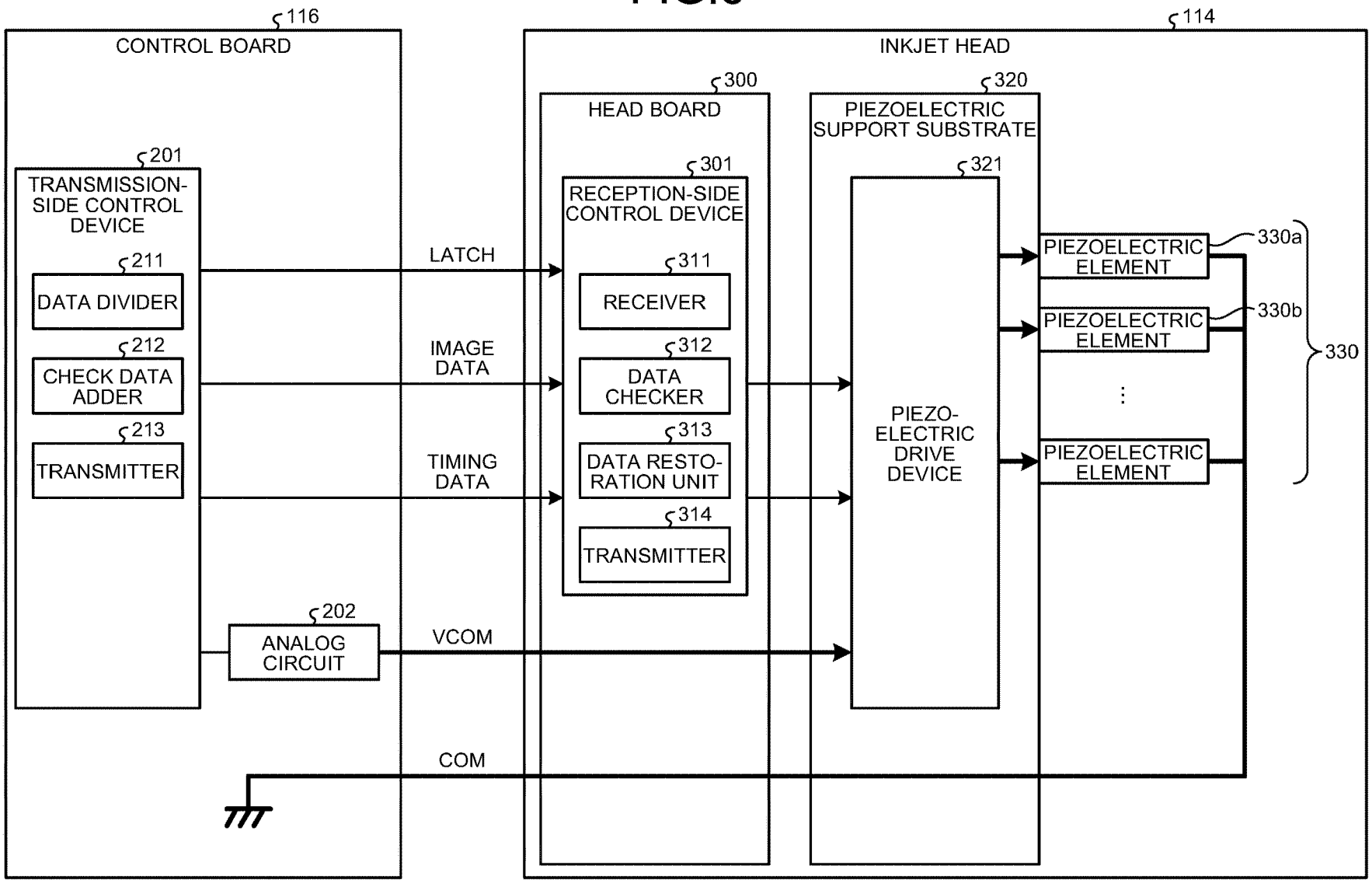
FIG. 6 is a diagram illustrating an example of configurations of a control board and an inkjet head of the image forming apparatus according to the embodiment.

FIG. 6 is a diagram illustrating an example of configurations of the control board and the inkjet head of the image forming apparatus according to the embodiment. With reference to FIG. 6, the configurations of the control board 116 and the inkjet head 114 of the image forming apparatus 1 according to the embodiment will be described.

As described above, the control board 116 is a control board that controls an operation of ejecting ink performed by the inkjet head 114. As illustrated in FIG. 6, the control board 116 includes a transmission-side control device 201 and an analog circuit 202.

The transmission-side control device 201 is a device that consists of a field programmable gate array (FPGA), an application specific integrated circuit (ASIC), or the like, and that transmits latch signals for image data (simply referred to as latch signals below), image data for selecting a drop type, and timing data (mask data) for selecting on or off of an analog switch to the inkjet head 114. As illustrated in FIG. 6, the transmission-side control device 201 includes a data divider 211 (divider), a check data adder 212 (adder), and a transmitter 213 (first transmitter) as functional processors.

The data divider 211 is a processor that divides image data into a plurality of data chronologically.

The check data adder 212 is a processor that adds check data, such as a checksum of a parity for error detection to each of the image data that are divided by the data divider 211 (division data).

The transmitter 213 is a processor that transmits each of the image data that are divided by the data divider 211 and to which check data is added by the check data adder 212 to the inkjet head 114. The transmitter 213 further transmits the aforementioned latch signal and timing data (mask data) to the inkjet head 114. The latch signal is a signal serves as a reference of the timing of data transmission from the transmission-side control device 201 to a reception-side control device 301.

The analog circuit 202 is a circuit that generates a drive waveform that is referred to as VCOM and transmits the drive waveform to a piezoelectric drive device 321 of the inkjet head 114 to be described below.

As described above, the inkjet head 114 is a liquid ejection head that ejects ink to the recording medium P that is carried on the sheet carrier drum 112 to form an image. As illustrated in FIG. 6, the inkjet head 114 includes a head board 300, a piezoelectric support substrate 320, and piezoelectric elements 330*a*, 330*b*, . . . .

The head board 300 includes a reception-side control device 301.

The reception-side control device 301 is a device that consists of a FPGA, an ASIC, or the like, and that receives the latch signal, the image data and the timing data (mask data), which are transmitted from the transmission-side control device 201, and that performs various types of processing. As illustrated in FIG. 6, the reception-side control device 301 includes a receiver 311, a data checker 312 (error detector), a data restoration unit 313, and a transmitter 314 (second transmitter) as functional processors.

The receiver 311 is a processor that receives the latch signal, the image data, and the timing data (mask data) that are transmitted from the transmission-side control device 201.

The data checker 312 is a processor that performs error detection on image data received from the receiver 311, using check data that is added to the image data. The control board 116 and the inkjet head 114 are often connected via a harness for transmitting and receiving data and there is a risk that a data error in the image data would occur due to the effect of noise, or the like. Thus, in the image forming apparatus 1 according to the present embodiment, as described above, the check data adder 212 adds check data to image data and the data checker 312 performs data detection on the image data using the check data.

The data restoration unit 313 is a processor that, when the check data adder 212 has added a horizontal parity and a vertical parity as check data to image data, performs a so-called two-dimensional parity check using the horizontal parity and the vertical parity and restores image data in which the data checker 312 has detected an error. In the image forming apparatus 1 according to the present embodiment, the data restoration unit 313 is not necessarily required, and the data restoration unit 313 may be not included.

The transmitter 314 is a processor that transmits the image data on which the data checker 312 has performed an error detection process and the timing data (mask data) to the piezoelectric drive device 321 to be described below. Specifically, the transmitter 314 transmits image data in which the data checker 312 detects no error or image data that is restored by the data restoration unit 313 in the case where the data checker 312 detects an error in image data to the piezoelectric drive device 321. When the data restoration unit 313 fails in restoration, the transmitter 314 transmits image data of the same area preceding the image data by one period (for example, preceding by one scan). In the case where the data restoration unit 313 is not included, when the data checker 312 detects an error in image data, the transmitter 314 may transmit image data of the same area preceding the image data by one period, instead of the image data.

Details of a restoration process by the data restoration unit 313 and a process of transmitting image data preceding by one period by the transmitter 314 will be described below using FIG. 10.

The piezoelectric support substrate 320 includes the piezoelectric drive device 321.

The piezoelectric drive device 321 is a device that generates analog signals that are applied to the piezoelectric elements 330*a*, 330*b*, . . . , using an internal switch circuit (not illustrated in the drawing) based on the image data and the timing data (mask data), which are received from the reception-side control device 301, and the VCOM, which is received from the analog circuit 202. The piezoelectric drive device 321 loads data from the reception-side control device 301 at the timing when the reception-side control device 301 receives the latch signal.

The piezoelectric elements 330*a*, 330*b*, . . . are piezoelectric elements that are displaced according to the voltage of the analog signal that is applied from the piezoelectric drive device 321 and that eject ink from nozzle holes.

Part or all the data divider 211, the check data adder 212, the transmitter 213, the receiver 311, the data checker 312, the data restoration unit 313, and the transmitter 314 may be implemented not by a hardware circuit, such as an integrated circuit, but by the CPU 501 by executing a program.

Image Data Transmission and Reception by Conventional Image Forming Apparatus

Figure 7:
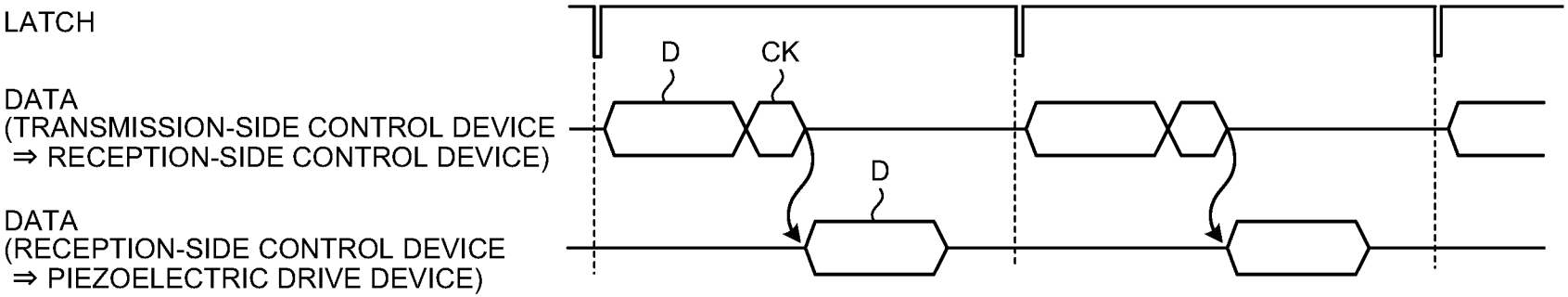
FIG. 7 is a diagram illustrating an example of a timing chart of data transmission and reception in a conventional image forming apparatus.
Figure 8:
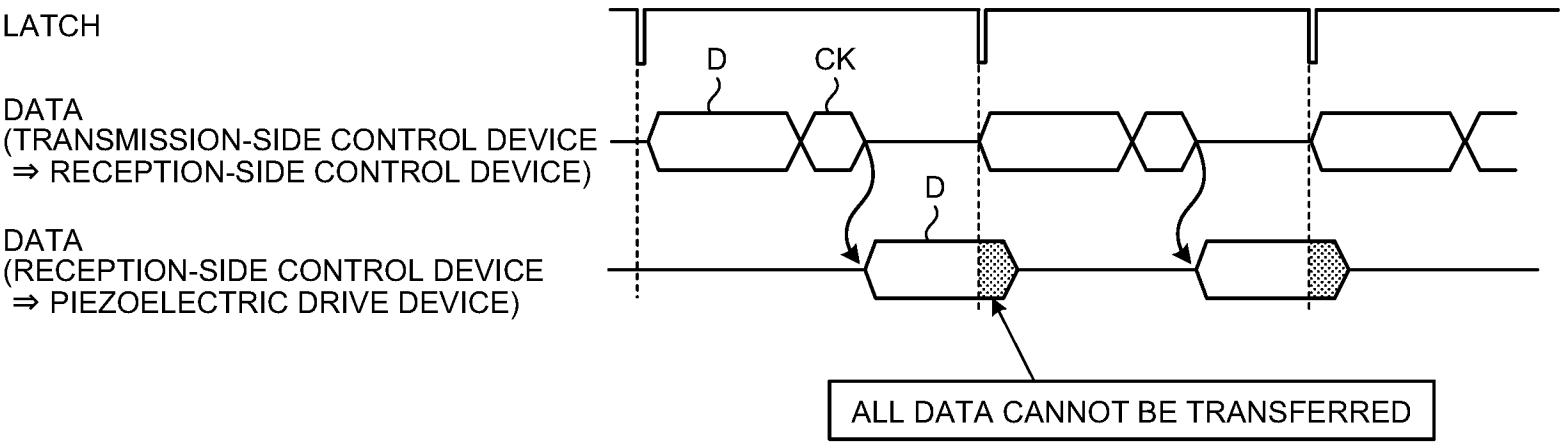
FIG. 8 is a diagram illustrating an example of a timing chart in the case where latch signals have short intervals in the conventional image forming apparatus.

FIG. 7 is a diagram illustrating an example of a timing chart of data transmission and reception in a conventional image forming apparatus. FIG. 8 is a diagram illustrating an example of a timing chart in the case where the interval of latch signals is short in the conventional image forming apparatus. With reference to FIGS. 7 and 8, image data transmission and reception by the conventional image forming apparatus will be described.

As described above, transmission of data, such as image data and timing data (mask data), from the transmission-side control device to the reception-side control device is performed based on a latch signal. Check data for error detection, such as a checksum or a parity (for example, the check data CK illustrated in FIG. 7) is added to image data to be transmitted (for example, image data D illustrated in FIG. 7). The reception-side control device performs error detection on the image data using the check data and, when no error is detected in the image data, transfers the image data, etc., to the piezoelectric drive device. The piezoelectric drive device receives the image data that is transferred from the reception-side control device and loads the image data into an internal circuit according to the latch signal.

The above-described latch signal is a signal corresponding to a period of ejection of ink in the inkjet head and therefore, in the case where the printing speed increases, or the case where accurate printing is performed, or the like, the ejection period shortens and the period of latch signal shortens, too. When the period of latch signal shortens as described above, as illustrated in FIG. 8, there is a risk that the timing of the next latch signal would come during the transfer of image data from the reception-side control device to the piezoelectric drive device and the piezoelectric drive device loads the image data into the internal circuit in the state of not having received all the image data and this would result in abnormal data and an abnormal image would be printed on a recording medium.

Figure 9:
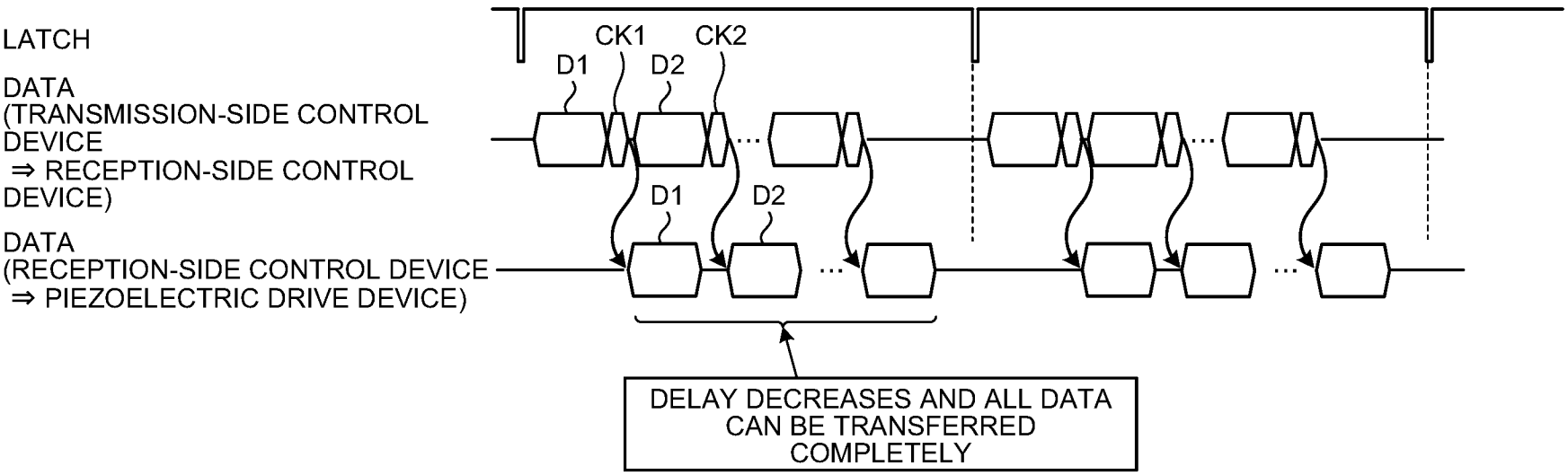
FIG. 9 is a diagram illustrating an example of a timing chart of data transmission and reception in the image forming apparatus according to the embodiment.
Figure 10:
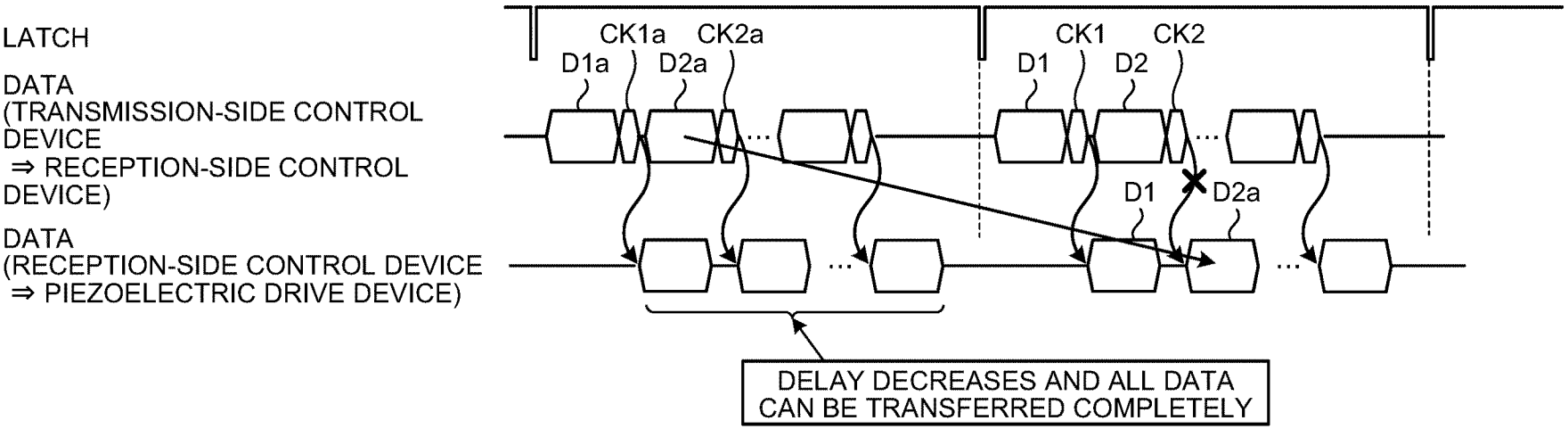
FIG. 10 is a diagram illustrating an example of a timing chart of data transmission and reception in the case where data is transmitted as a substitute in the image forming apparatus according to the embodiment.

In order to solve the above-described problem, the image forming apparatus 1 according to the present embodiment performs the following operations illustrated in FIG. 9 and FIG. 10.

Image Data Transmission and Reception by Image Forming Apparatus according to Present Embodiment FIG. 9 is a diagram illustrating an example of a timing chart of data transmission and reception in the image forming apparatus according to the embodiment. FIG. 10 is a diagram illustrating an example of a timing chart of data transmission and reception in the case where data is transmitted as a substitute in the image forming apparatus according to the embodiment. With reference to FIG. 9 and FIG. 10, image data transmission and reception by the image forming apparatus 1 according to the embodiment will be described.

In the embodiment, when image data is transmitted during one period of latch signal to the reception-side control device 301 from the transmission-side control device 201, check data is not added to the image data and the following processing is performed. In other words, when image data is transmitted from the transmission-side control device 201 to the reception-side control device 301, the data divider 211 of the transmission-side control device 201 chronologically divides the image data into a plurality of image data D1, D2, . . . as illustrated in FIG. 9. The check data adder 212 of the transmission-side control device 201 then adds check data CK1, CK2, . . . , such as checksums or parities for error detection, to the image data D1, D2 . . . that are divided by the data divider 211. The transmitter 213 of the transmission-side control device 201 transmits the image data D1, D2, . . . that are divided by the data divider 211 and to which the check data adder 212 adds the check data CK1, CK2, . . . to the reception-side control device 301 of the inkjet head 114.

The receiver 311 of the reception-side control device 301 receives the image data D1, D2, . . . to which the check data CK1, CK2, . . . are added. Every time the receiver 311 receives image data, the data checker 312 of the reception-side control device 301 performs error detection on each set of image data using check data (check data CK1, CK2, . . . ) that is added to the image data (image data D1, D2 . . . ). Accordingly, in the reception-side control device 301, as illustrated in FIG. 9, without reception of the whole image data, the transmitter 314 is able to transmit a set of image data on which error detection process has been performed to the piezoelectric drive device 321 at the time when error detection completes on a divided image data basis. In other words, as illustrated in FIG. 9, reception of image data from the transmission-side control device 201 to the reception-side control device 301 and transmission of image data from the reception-side control device 301 to the piezoelectric drive device 321 are executable in parallel. Thus, as illustrated in FIG. 8 described above, it is possible to avoid the situation with the conventional technique where image data cannot be transmitted completely until the next latch signal and the above-described parallel processing makes it possible to perform error detection on image data and increase the printing speed. FIG. 9 illustrates the example in which transmission of the image data D2 from the transmission-side control device 201 to the reception-side control device 301 and transmission of the image data D1 from the reception-side control device 301 to the piezoelectric drive device 321 are performed in parallel; however, transmission is not limited to this. For example, transmission of the image data (the image data D3 not illustrated in the drawing) following the image data D2 from the transmission-side control device 201 to the reception-side control device 301 and transmission of the image data D1 from the reception-side control device 301 to the piezoelectric drive device 321 may be performed in parallel.

In the case where the reception-side control device 301 includes the data restoration unit 313, when the check data adder 212 adds a horizontal parity and a vertical parity as check data to image data, the data restoration unit 313 performs a so-called two-dimensional parity examination using the horizontal parity and the vertical parity and restores the image data in which the data checker 312 has detected an error. The transmitter 314 of the reception-side control device 301 transmits, to the piezoelectric drive device 321, image data in which no error has been detected in the error detection process performed by the data checker 312 or image data that is restored by the data restoration unit 313 when the data checker 312 detects an error in the image data. When the data restoration unit 313 fails in restoration, the transmitter 314 transmits image data of the same area preceding the image data by one period (for example, preceding by one scan) (for example, as illustrated in FIG. 10, the image data D2*a* preceding the divided image data D2 by one period). Note that, in the case where the data restoration unit 313 is not included, when the data checker 312 detects an error in image data, the transmitter 314 may transmit image data of the same area preceding the image data by one period. Accordingly, even when an error occurs in image data (even when it is not possible to restore the image data with the error), it is possible to perform a printing process that makes it difficult to determine an abnormal image visually.

When at least any of the processors of the image forming apparatus 1 is implemented by executing a program in the above-described embodiment, the program is provided by incorporating in a ROM, or the like, previously. In the above-described embodiment, a program to be executed by the image forming apparatus 1 may be configured such that the program is recorded in a file in an installable or executable form in a computer-readable recording medium, such as a CD-ROM (Compact Disc Read Only Memory), a flexible disc (FD), a CD-R (Compact Disc-Readable) or a DVD (Digital Versatile Disc). In the above-descried embodiment, a program to be executed by the image forming apparatus 1 may be configured such that the program is stored in a computer that is connected to a network, such as the Internet, is downloaded via the network, and thus is provided. In the above-described embodiment, a program to be executed by the image forming apparatus 1 has a module configuration including at least any one of the processors described above and, as for actual hardware, the CPU 501 reads the program from the above-described storage device (the ROM 502 or the auxiliary storage device 504) and executes the program, so that each of the above-described processors is loaded in the main storage device (the RAM 503) and is generated.

According to an embodiment, it is possible to increase a printing speed while performing error detection on image data to an inkjet head.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid ejection apparatus comprising:

a transmission-side control device configured to transmit image data to an ejection head; and a reception-side control device configured to transmit data obtained by processing the image data received from the transmission-side control device, to a drive device configured to control a drive element, wherein the transmission-side control device comprises:

a divider configured to divide the image data into a plurality of division data;

an adder configured to add check data for error detection to each of the plurality of division data divided by the divider; and a first transmitter configured to transmit, to the reception-side control device, each of the plurality of division data to which the adder adds respective check data, and the reception-side control device comprises:

a receiver configured to receive each of the plurality of division data that are transmitted from the first transmitter, and to which the respective check data are added;

an error detector configured to perform error detection on each of the plurality of division data received by the receiver, using check data added to the division data; and a second transmitter configured to transmit, to the drive device, division data on which a process of error detection is performed by the error detector, in parallel with a process of transmitting division data by the first transmitter.

2. The liquid ejection apparatus according to claim 1, wherein the error detector is configured to, every time the receiver receives division data to which check data is added, perform error detection on the division data using the check data.

3. The liquid ejection apparatus according to claim 1, wherein the adder is configured to add a horizontal parity and a vertical parity as check data to each of the plurality of division data.

4. The liquid ejection apparatus according to claim 3, wherein the reception-side control device further comprises a data restoration unit configured to, in response to the error detector detecting an error in division data, restore the division data by performing a two-dimensional parity examination using a horizontal parity and a vertical parity added to the division data.

5. The liquid ejection apparatus according to claim 4, wherein the second transmitter is configured to, in response to the data restoration unit failing to restore the division data, transmit, to the drive device, division data preceding the division data by one scan, instead of the division data.

6. The liquid ejection apparatus according to claim 1, wherein the second transmitter is configured to, in response to the error detector detecting an error in division data, transmit, to the drive device, division data preceding the division data by one scan, instead of the division data.

7. The liquid ejection apparatus according to claim 1, further comprising the drive device configured to control a piezoelectric element as the drive element.

8. A data transmission method performed by a liquid ejection apparatus including a transmission-side control device configured to transmit image data to an ejection head, and a reception-side control device configured to transmit data obtained by processing the image data received from the transmission-side control device to a drive device configured to control a drive element, the method comprising:

dividing the image data into a plurality of division data, in the transmission-side control device;

adding check data for error detection to each of the plurality of divided division data, in the transmission-side control device;

first transmitting, to the reception-side control device, each of the plurality of division data to which respective check data are added, in the transmission-side control device;

receiving each of the plurality of division data that are transmitted at the first transmitting and to which the respective check data are added, in the reception-side control device;

performing error detection on each of the plurality of received division data, using check data added to the division data, in the reception-side control device; and second transmitting, to the drive device, division data on which a process of error detection is performed, in parallel with a process of transmitting division data at the first transmitting.

* * * * *